US007371122B2

(12) United States Patent
Ivanova et al.

(10) Patent No.: US 7,371,122 B2
(45) Date of Patent: May 13, 2008

(54) POWER STRIP MODULES AND SYSTEMS

(76) Inventors: Irina Ivanova, 164 E. 33rd St., Apt. 9, New York, NY (US) 10016; Botir T. Sagdullaev, 164 E. 33rd St., Apt. 9, New York, NY (US) 10016

( * ) Notice: Subject to any disclaimer, the term of this patent is extended or adjusted under 35 U.S.C. 154(b) by 0 days.

(21) Appl. No.: 11/558,881

(22) Filed: Nov. 10, 2006

(65) Prior Publication Data

US 2007/0123108 A1 May 31, 2007

Related U.S. Application Data

(63) Continuation-in-part of application No. 29/242,439, filed on Nov. 11, 2005, now Pat. No. Des. 540,257.

(60) Provisional application No. 60/760,992, filed on Jan. 19, 2006.

(51) Int. Cl.
*H01R 125/00* (2006.01)

(52) U.S. Cl. ..... 439/652

(58) Field of Classification Search ..... 439/103, 439/214, 105, 652, 651

See application file for complete search history.

(56) References Cited

U.S. PATENT DOCUMENTS

| | | | | |
|---|---|---|---|---|
| 1,611,806 A | * | 12/1926 | Barnett | 439/651 |
| D86,613 S | | 3/1932 | Lauter | |
| D138,086 S | | 6/1944 | Ludwig | |
| 2,443,367 A | * | 6/1948 | Aguilar et al. | 439/652 |
| D152,992 S | | 3/1949 | Ludwig | |
| 2,673,969 A | | 3/1954 | Pfister | |
| 4,085,996 A | | 4/1978 | Koslo | |
| D251,293 S | | 3/1979 | Trueblood | |
| 4,293,172 A | | 10/1981 | Lingaraju | |
| D276,225 S | | 11/1984 | Powel | |
| D318,849 S | | 8/1991 | Luu | |
| D319,849 S | | 9/1991 | Stoddard et al. | |
| D324,029 S | | 2/1992 | Luu | |
| D327,873 S | | 7/1992 | Luu | |
| D329,423 S | | 9/1992 | Luu | |

(Continued)

OTHER PUBLICATIONS

Products—I (A-C, 1 sheet) depicting nine miscellaneous exemplars are dating Nov. 11, 2005.

(Continued)

*Primary Examiner*—Phuong Dinh
(74) *Attorney, Agent, or Firm*—Darby & Darby

(57) ABSTRACT

A power distribution system, in particular a power strip, includes one or more modules. The module housing typically approximates the shape of a rectangular or triangular block. In a preferred embodiment, the module approximates a cube and provides six major surfaces, each approximately at right angle to its neighboring major surfaces. Preferably, one major surface provides a male plug, while each remaining major surface provides a single female electrical socket. Such a module is spatially compact, aesthetically and visually appealing, and relieves the excessive bulk of oversized plugs that would otherwise block access to one or more sockets. A single module offers a stand-alone socket adapter, while a plurality of compatible modules can be joined together to form an adjustable power strip. Modules can be distinguished, such as by color, to specify function or use, and compatible modules can be conveniently provided in a kit.

20 Claims, 10 Drawing Sheets

U.S. PATENT DOCUMENTS

| | | | | |
|---|---|---|---|---|
| D349,885 | S | 8/1994 | Lee et al. | |
| D356,544 | S | 3/1995 | Fladung | |
| D365,802 | S | 1/1996 | Fladung | |
| D368,893 | S | 4/1996 | Harwood et al. | |
| 5,616,968 | A * | 4/1997 | Fujii et al. | 307/66 |
| 5,857,875 | A * | 1/1999 | Hsu et al. | 439/652 |
| D411,168 | S | 6/1999 | Rossman et al. | |
| D411,511 | S | 6/1999 | Rossman et al. | |
| D427,973 | S | 7/2000 | Giese | |
| 6,118,643 | A * | 9/2000 | Dyer et al. | 361/111 |
| D435,516 | S | 12/2000 | Stekelenburg et al. | |
| D436,923 | S | 1/2001 | Stekelenburg et al. | |
| 6,220,897 | B1 | 4/2001 | Maxwell et al. | |
| D445,401 | S | 7/2001 | Tong et al. | |
| D446,189 | S | 8/2001 | Lee | |
| D446,503 | S | 8/2001 | Lee | |
| 6,315,617 | B1 * | 11/2001 | Al-Sabah | 439/652 |
| D452,215 | S | 12/2001 | Stekelenburg et al. | |
| D458,225 | S | 6/2002 | Stekelenburg et al. | |
| 6,485,327 | B1 | 11/2002 | Morlock et al. | |
| D484,099 | S | 12/2003 | Bettencourt | |
| D486,792 | S | 2/2004 | Stoughton | |
| D492,253 | S | 6/2004 | Lee et al. | |
| D495,657 | S | 9/2004 | Lee et al. | |
| D505,917 | S | 6/2005 | Murphy | |
| D512,963 | S | 12/2005 | Lee et al. | |
| D514,067 | S | 1/2006 | Lee et al. | |
| 2003/0129869 | A1 * | 7/2003 | Milan | 439/214 |

OTHER PUBLICATIONS

Products—II (A-D, 1 sheet) depicting four miscellaneous exemplars are dating Nov. 11, 2005.

Products—III (A-C, 1 sheet) depicting three miscellaneous exemplars are dating Nov. 11, 2005.

* cited by examiner

FIG. 1 (A-B)
(A)
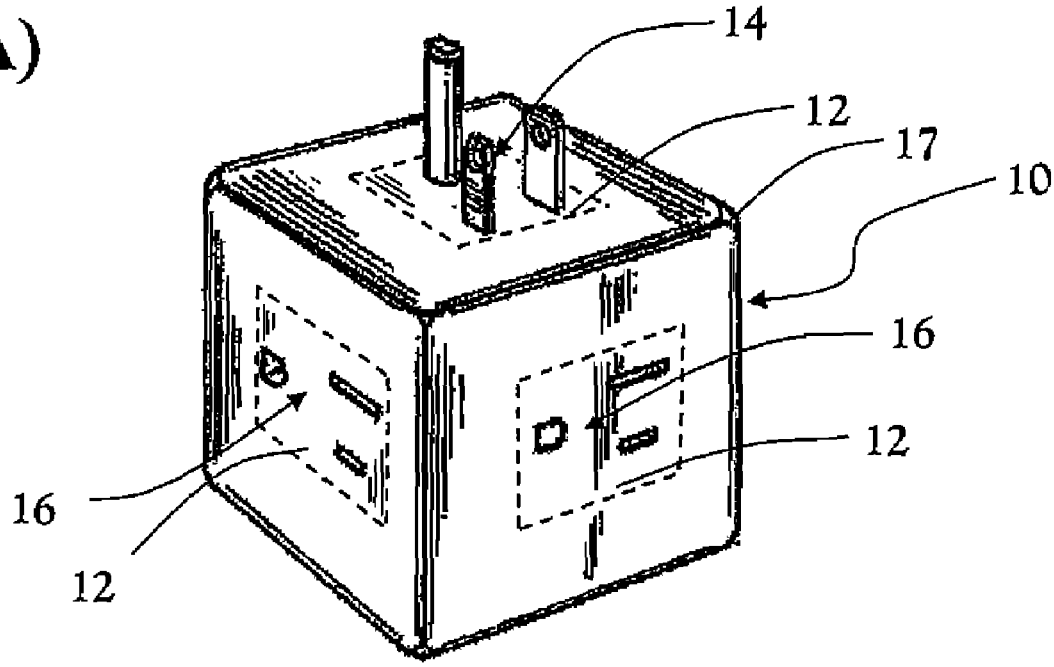
(B)
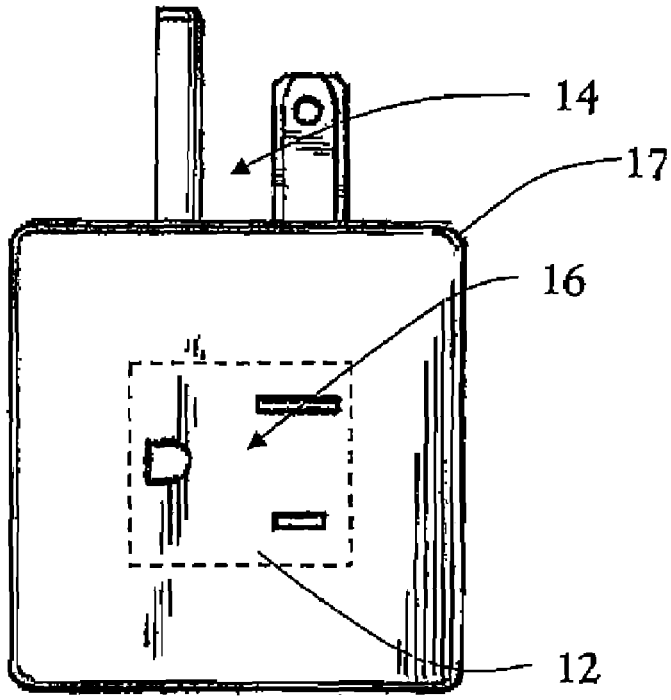

FIG. 1 (C-E)
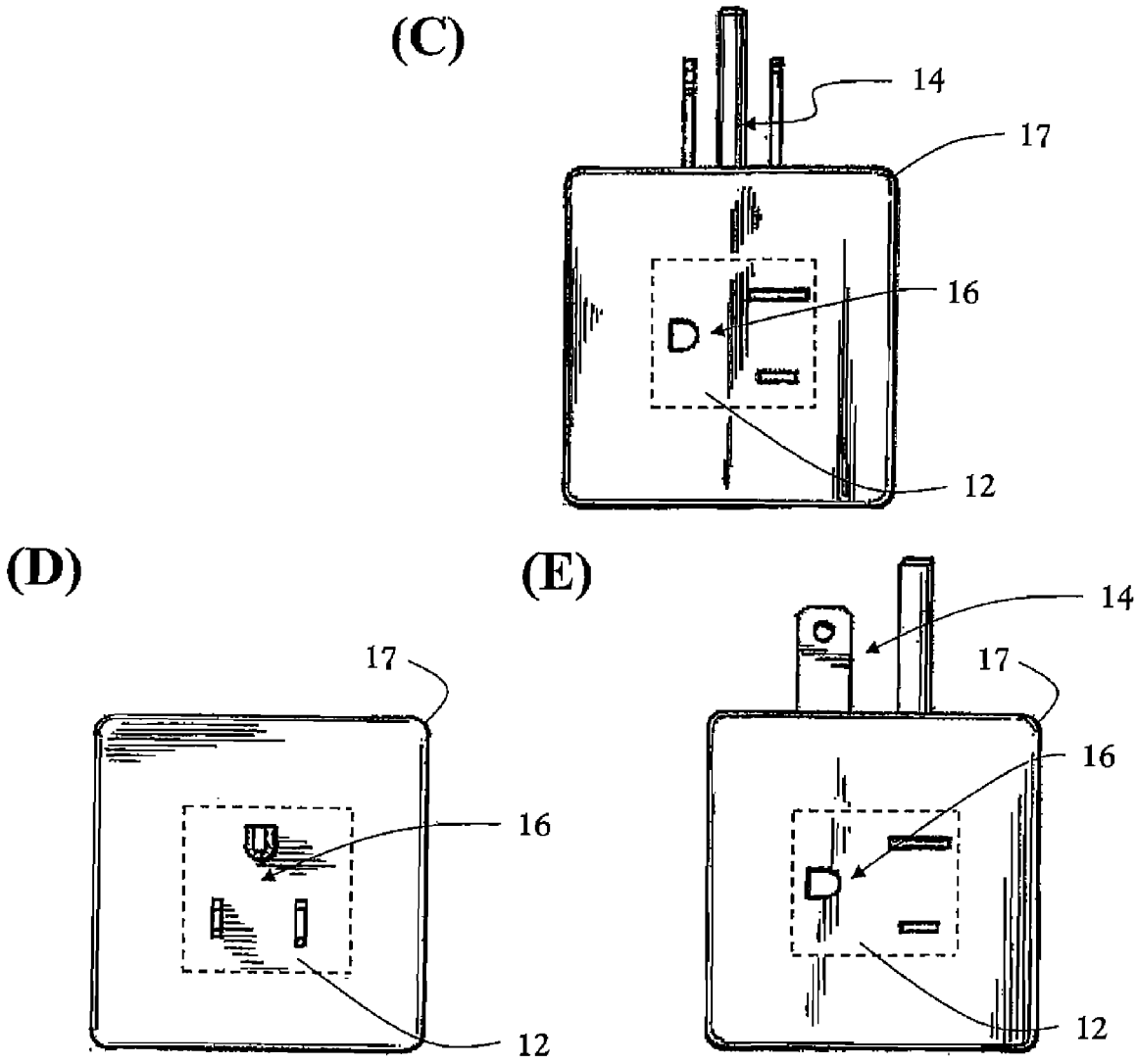

FIG. 1 (F-G)
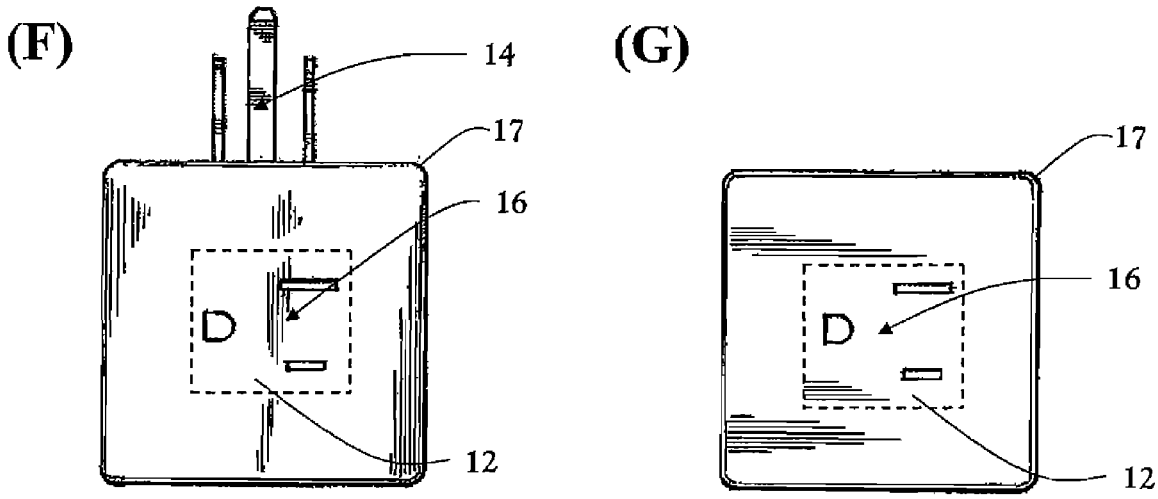

FIG. 4 (A-D)
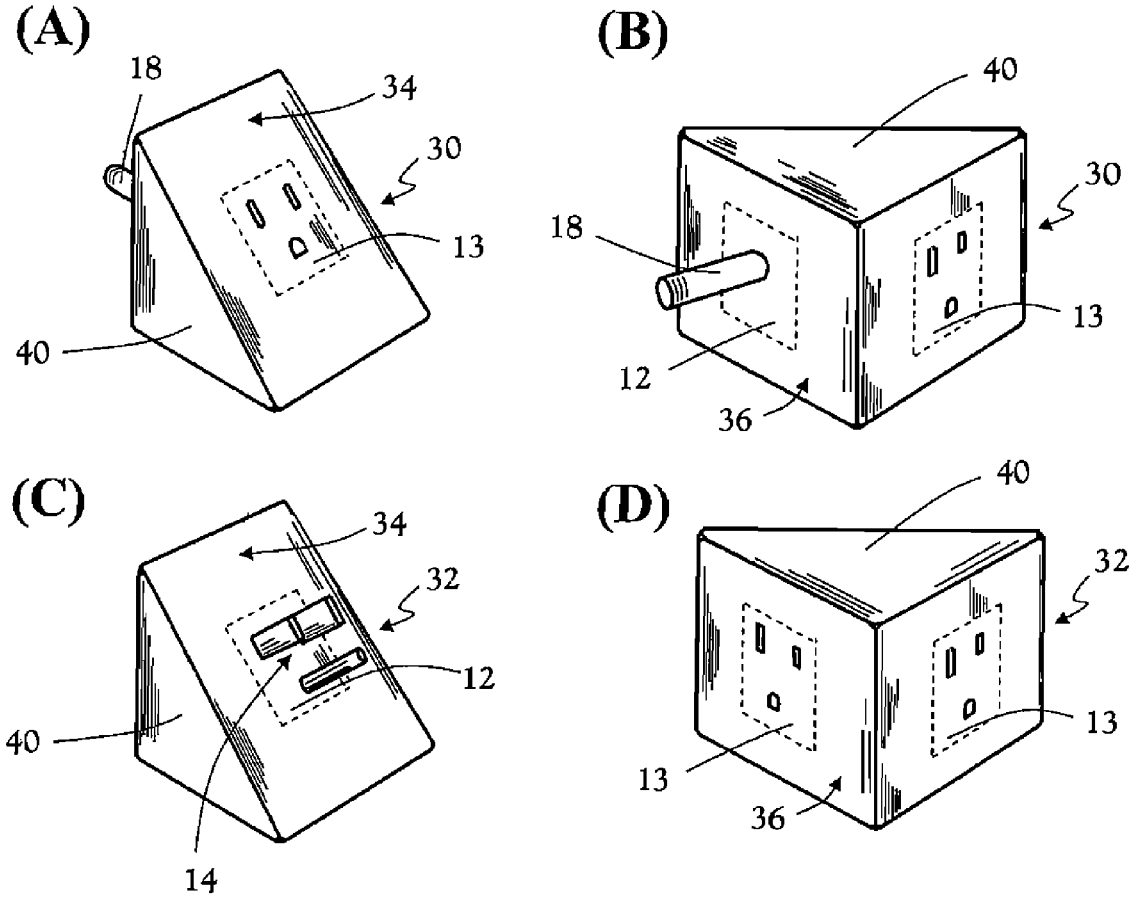

(E)

FIG. 5
(A)
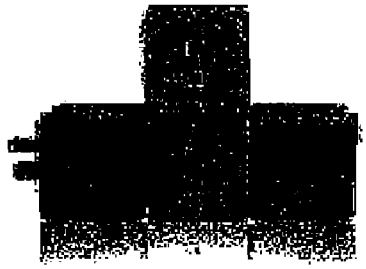
(B)
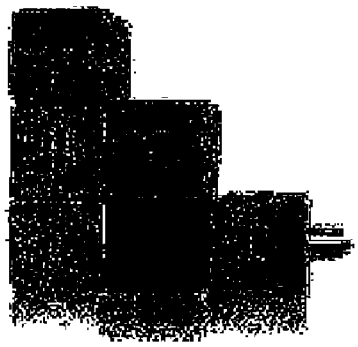
(C)
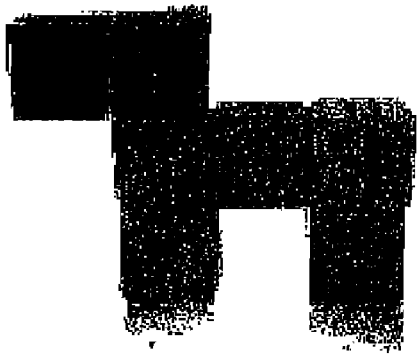

POWER STRIP MODULES AND SYSTEMS

CROSS-REFERENCE TO RELATED APPLICATIONS

This application is a continuation in part of U.S. Design patent application Ser. No. 29/242,439 filed on Nov. 11, 2005, and this application claims priority to U.S. Provisional Patent Application Ser. No. 60/760,992 filed on Jan. 19, 2006. Each of the above-identified patent applications is incorporated herein, by reference, in its entirety.

FIELD OF THE INVENTION

This invention relates generally to electrical adapters and power distribution systems and, particularly to power strip modules and power strip systems.

BACKGROUND OF THE INVENTION

Power distribution systems, such as power strips, are commonly used to distribute a power input to multiple outlets, e.g., female connectors, sockets, jacks. A common example of such a system is a power strip, or variant thereof, which has one end that is fitted with an electrical plug, i.e., a male connector, and another end that is connected to a fixed housing that has multiple outlets.

Power strips are found in numerous settings, including household and work environments, where there are not enough built-in outlets to supply power to the desired electrical devices. Common devices that frequently rely on power strips include televisions, home entertainment systems, videocassette recorders, DVD players, cable boxes, speakers, stereos, compact disk players, lights, lamps, etc, Likewise, many kitchens today rely on such systems to distribute power to multiple appliances, such as coffer makers, can-openers, food processors, juicers, microwaves, blenders, and toaster ovens, etc. More generally, the advent of the electronic age has increased the need for such power distribution systems. Computer systems, for example, typically depend on power strips to distribute electricity to printers, scanners, digital cameras, back up drives, multiple monitors, external speakers, etc.

Despite their widespread use and increasing prevalence, known power strips have significant shortcomings. First, electrical outlets in such systems are spaced tightly together, typically in the same orientation. But this can lead to several problems. Because plugs vary greatly in size, shape, and orientation, a large plug can block one or more adjacent outlets, precluding access. And even if adjacent outlets are not blocked, their close proximity often makes it difficult to insert or remove one or more plugs. Fueling this frustration is the increasing need for bulky plugs, such as AC/DC adapter plugs with transformers, resulting from the growing demand for electronic and computer devices.

A second limitation is that known power strips often have a bulky, static housing with a fixed number of outlets. But this renders such systems cumbersome and inconvenient to transport, especially when a user requires only a subset of outlets. More generally, the bulky shape contributes to an unsightly appearance and can result in a safety hazard if the system is placed near foot traffic etc. Consequently, known power strips are usually placed in hidden, hard-to-reach locations, further impeding access and use.

Thus, there is a need in the art for power distribution systems that improve access to bulky electrical plugs, provide a spatially compact design, and can adjust in conformance with a user's needs and preferences. The present invention addresses these and other needs in the art by providing a power distribution system based on one or more modules.

SUMMARY OF THE INVENTION

In one embodiment, the present invention provides a kit comprising components for a modular power distribution system, in particular a modular socket kit for an electrical outlet. The kit comprises at least two modules, the housing for each module including at least three major surfaces, wherein each major surface is at an angle to each neighboring major surface. More particularly, the housing is approximately shaped as a rectangular box, in particular a cube, including six major surfaces, wherein each major surface is approximately at a right angle to each neighboring major surface.

The first module has a male electrical plug, preferably extending from a first major surface, where the plug is adapted to access an external power outlet. The plug may be connected directly to the module housing or it may be connected indirectly, e.g., through a power cord. The module also includes a plurality of female electrical sockets, which are positioned on two or more of the remaining major surfaces and electrically connected to the male plug. More particularly, at least two, and preferably all five, of the remaining major surfaces each include a single female electrical socket. If desired, the first module can also include a power switch as well as a surge protector electrically connected between the male plug and the female sockets to provide surge protection to a device connected to any of the female sockets.

The second module has a male electrical plug that extends from a first major surface and is adapted to be received by at least one female socket of the first module. The module also includes a plurality of female electrical sockets, which are located on two or more of the remaining major surfaces, and are electrically connected to the male plug. More particularly, at least two, and preferably all five, of the remaining major surfaces each include a single female electrical socket.

While a rectangular or cubic module is preferred, the module can also have other shapes as long as there are at least three major surfaces which are at an angle to each other where adjacent. More particularly, two of the major surfaces are approximately at right angles to each other. A triangular module is an example.

If desired, one or more of the modules in the kit may include visible identification, such as a particular color, to denote its functional features or to indicate its intended use, such as with a particular electrical device.

In yet another embodiment, a single module of the present invention can provide a stand-alone socket adapter for an electrical outlet.

BRIEF DESCRIPTION OF THE DRAWINGS

The above features and many other attendant advantages of the invention will become understood by reference to the following detailed description when taken in conjunction with companying drawings wherein:

FIG. 1(A) is a top, left and front perspective view of a first embodiment of a power strip module;

FIG. 1(B) is a left side elevation view of the module of FIG. 1 (*a*);

FIG. 1(C) is a front side elevation view of the module of FIG. 1(*a*);

FIG. 1(D)) is a top plan view of the module of FIG. 1(*a*);

FIG. 1(E) is a right side elevation view of the module of FIG. 1(*a*);

FIG. 1(F) is a rear elevation view of the module of FIG. 1(*a*);

FIG. 1(G) is a bottom plan view of the module of FIG. 1(*a*);

FIG. 5 depicts specific embodiments of power strip systems where FIG. 5(A) is based on four connected modules, FIG. 5(B) is based on six connected modules, and FIG. 5(C) is based on seven connected modules.

Figure 2:
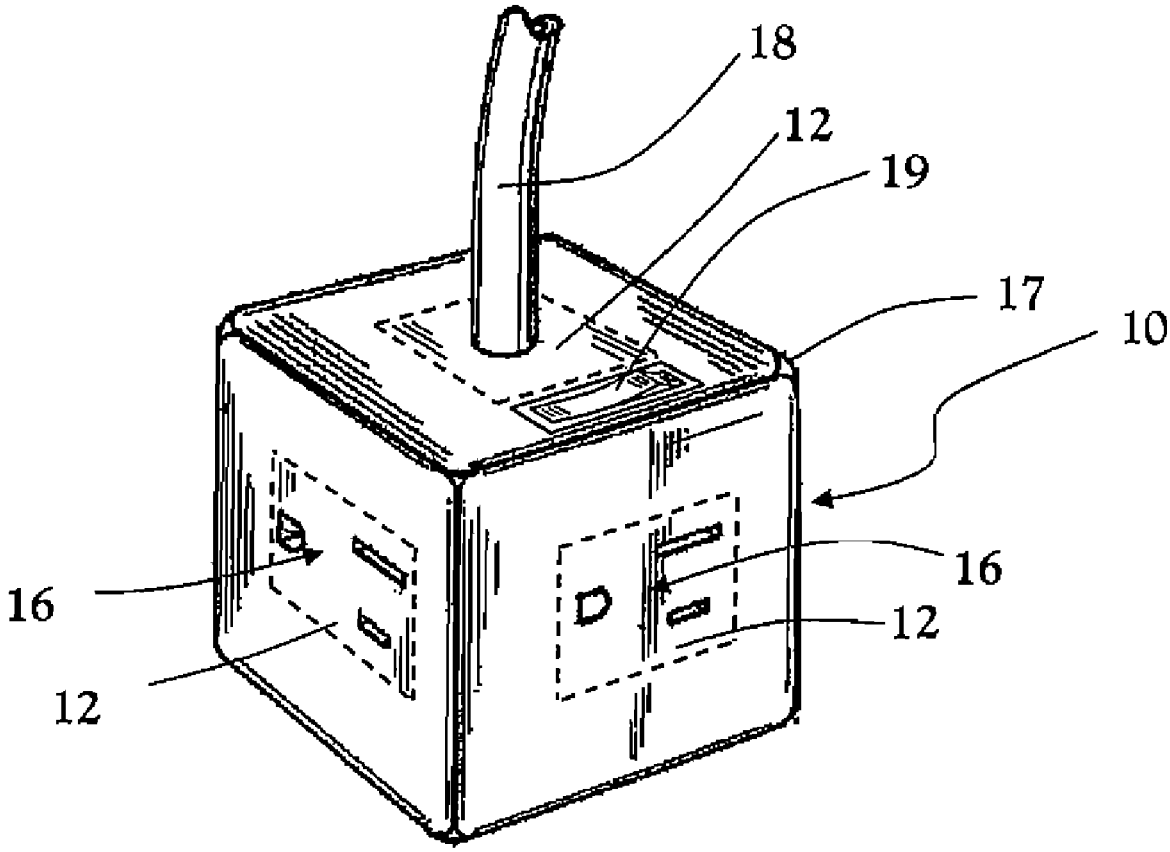
FIG. 2 is a top, left, and front perspective view of a power strip module, showing a cord as the input on the top side.

Reference numbers refer to the same or equivalent parts of the present invention throughout the several Figures of the drawings.

DETAILED DESCRIPTION OF THE INVENTION

The present invention addresses the limitations of known power distribution systems, in particular power strips. These limitations include impeded plug access and removal, overall bulkiness, and limited adaptability. To address these problems, the present application discloses power distribution systems based on one or more compact, versatile, and adaptable modules.

A module of the present invention includes a housing that can be formed of any rigid material, such as plastic, metal, ceramic, wood, and the like, and combinations thereof. The housing provides multiple faces that may be suitable for locating electrical connectors. Preferably, each housing face is suitable for locating an electrical connector. In one set of embodiments, the housing has the approximate shape of a rectangular block, providing six suitable faces. More particularly as exemplified by modules 10, 20, 22, 24, and 26 in FIGS. 1-3, the housing has the approximate shape of a cube having six suitable faces.

Preferably, each face that is suitable for an electrical connector includes a major surface. A major surface on a face is preferably continuous and has a sufficient size and shape, typically flat and planar, so that an external electrical device (with a complementary surface) is supported and stabilized when connected to the face. Thus, a major surface provides intimate, or flush, contact between a module face and an external electrical device. On a module face with a female electrical socket, for example, a major surface can support and stabilize electrical devices having bulky, oversize plugs as well as those having standard-size plugs. Adjoining major surfaces also ensure intimate and stable contact between the faces of two different modules, such as those between modules 20 and 22 in FIG. 3A.

In preferred embodiments, such as that exemplified by module 10, the housing provides six major surfaces 12, each approximately at a right angle to its neighboring major surfaces. Other embodiments may include additional major surfaces. A non-cubic, rectangular module, for example, might have more than one major surface on a long face.

In certain embodiments, a module may only comprise major surfaces. In a cube-shaped module, for example, each face is essentially flat and serves as a major surface. In such a case, neighboring major surfaces are directly contiguous. In other embodiments, two or more major surfaces may not be contiguous, and the module may also have minor surfaces. Minor surfaces can include distinct borders on a face. For example, even where a major surface is essentially planar with the module face, its boundary with a neighboring major surface may include a partial or continuous border. Such a border, for example, may comprise a beveled surface or a curved surface, such as curved edge 17 shown in the modules in FIGS. 1-2. Such a border may also be decorative or have a more complex shape or design. In another aspect, one or more minor surfaces may be found within the borders of the module face. Such surfaces may be raised or lowered, relative to the major surface, so long as the major surface can still provide adequate structural support for an external device connected to the corresponding face.

In the preferred embodiment, each module provides a single male connector, located on one face. The top face of the specific module shown in FIG. 1, for example, has a single plug 14 on major surface 12.

In one aspect, the plug is connected to an external power outlet, such as a wall outlet. When connected directly to an external outlet, the male connector will have a form dictated by the type of line current and outlet. Different parts of the world, for example, require distinct plugs that vary with respect to prong size, number and orientation. Plug 14, shown in FIGS. 1-2, for example, represents a typical three-pronged connector compatible with outlets in the United States. In another aspect, the plug of one module may be connected to a socket of another module, in which case its shape will be dictated by the corresponding socket type.

Figure 3A:
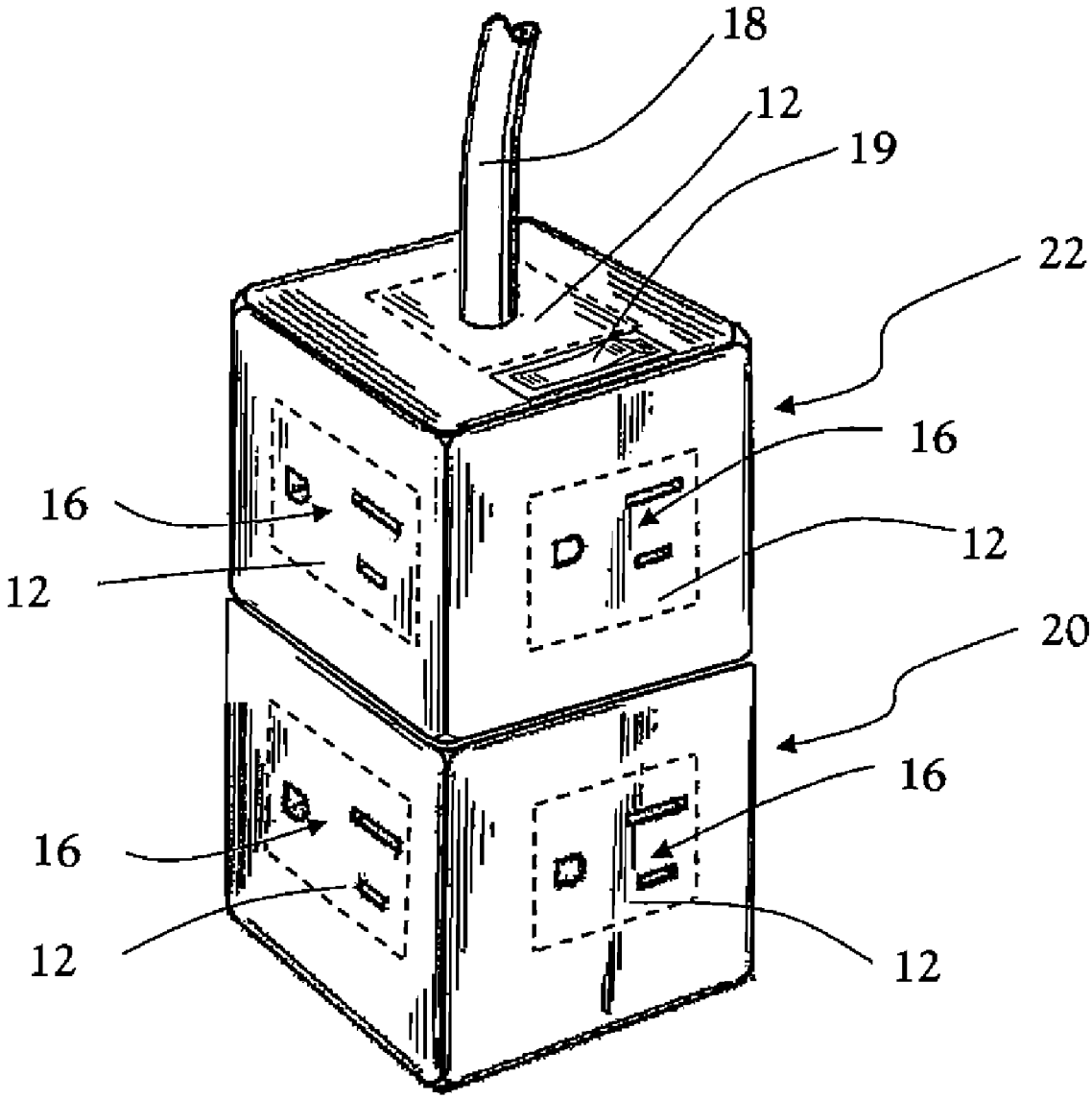
FIG. 3(A) illustrates a multi-module power strip, with the lower cube being the same as that shown in FIG. 1, and the upper cube being the same as that shown in FIG. 2.

In either aspect, the plug may extend directly or indirectly from the module. In the case of a direct extension, the male connector is connected to the housing without a cord, as shown, for example, by plug 14 in the embodiment of FIG. 1. In this case, the face with the plug preferably includes a major surface, such as the flat and planar, major surface 12, which facilitates intimate, or a flush, contact with the major surface on a socket-containing face of a second module. As shown in FIG. 3A, the planar surfaces where the modules connect to each other gives the system a trim, uniform appearance that is attractive.

Figure 3B:
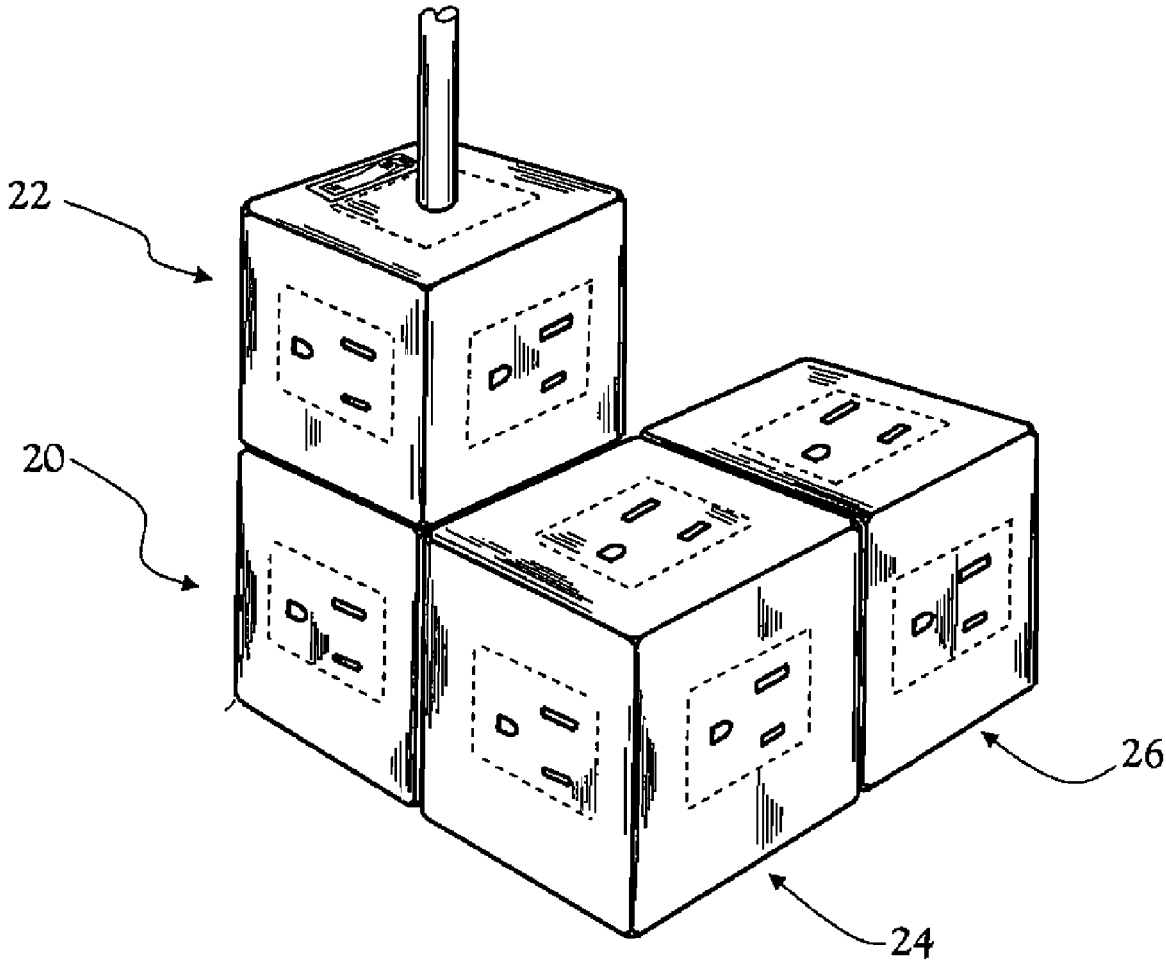
FIG. 3(B) illustrates a three dimensional multi-module power strip, comprising the two modules shown in (A) and two additional modules extending into the plane of the paper.

In the case of an indirect extension, the plug is not itself attached to the module face but is connected to it by an electrical cord, as exemplified by power cord input 18 in FIG. 2. With such a cord, which can have any desired length, the module may be connected to an external outlet that is located at a distance from the module. Such a configuration may be desirable, for example, if a user wishes to assemble an outlet system at a remote location away from a built in wall outlet, such as on a desk or high shelf. In such a configuration, the module face with the power cord may or may not include a major or planar surface. A power cord can also provide an electrical connection between two modules, allowing them to be physically segregated from each other in a single system. In this configuration, the module faces mediating the cord connection may or may not include a major or planar surface.

A power cord can be connected to the module at a point within a module face, such as power cord input 18 in FIG. 2, which is connected to the middle of the top face on major surface 12. Alternatively, such a cord may be connected to a module at the border between two faces. In the case of a cube-shaped module, such a border connection could then free up all six faces for electrical sockets.

In the preferred embodiment, each module includes, in addition to a male plug extending from one major surface, two or more female electrical sockets on the remaining major surfaces. Preferably, there is at most only one socket on each of the remaining major surfaces. The particular shape of the electrical socket will be dictated by the electrical system or systems used. For example, in some embodiments, such as those shown in FIGS. 1-2, all five remaining major surfaces each house a single female socket 16 that is compatible with standard U.S. pronged plugs. In a preferred embodiment, such as that depicted in FIGS. 1-2, the sockets are all oriented in the same direction. In other embodiments, however, one or more sockets may be oriented in a direction opposite to or perpendicular to that shown in FIGS. 1-2.

In one aspect, each female electrical socket is compatible with the male plug included in the module, such as in FIGS. 1-2. In another aspect, one or more female electrical sockets may be compatible with a male plug that is not included in the module. For example, the plug of a module may be compatible with a foreign outlet while the electrical sockets may be compatible with plugs from the user's home country. Such a configuration can be particularly advantageous in the case of business travelers carrying electronic equipment abroad. Such advantageous features are further complemented by the sleek design of the module, which enhances transportability of the system.

In accordance with the present invention, a single module, such as that depicted in FIG. 1 or FIG. 2, offers a stand-alone socket adapter. Alternatively, two or more modules can be electrically connected to each other, providing a diverse set of power distribution systems, such as those exemplified by the specific embodiments depicted in FIGS. 3-4.

In all embodiments, dispersing the sockets on major surfaces of the module housing can offer several advantages. Because the sockets are arranged in three dimensions with planar major surfaces at right angles to each other, the module is spatially compact. In addition, the relative orientation of the major surfaces with sockets facilitates simultaneous access to the sockets by multiple electrical devices, including those with bulky electrical plugs. A bulky adapter plug connected to one major surface, for example, will be approximately aligned with the major surface, and thus be adequately supported and stabilized. An adapter plug connected to one socket will therefore not cover a socket on the neighboring major surface, which is oriented approximately 90 degrees away. This improves the likelihood that the adjacent sockets can be used. In addition, such socket dispersal also facilitates plug insertion and removal. For example, when multiple devices are connected to the module, it is easy to plug in or unplug one device without disturbing a neighboring device.

In one set of embodiments, a single module provides a stand-alone socket adapter. As exemplified in FIG. 1, for example, module 10 has the approximate shape of a cube, with curved edges. Each face of the adapter is flat and approximately two inches wide. In other adapter embodiments, the face may be larger or smaller, depending on a number of factors, such as the style, number and orientation of the sockets and the type of electrical devices to be connected. For example, increasing the size of triangular module 30 in FIG. 4B would increase the surface area on left face 40 (as well as the hidden face opposite to it). Such an expanded face may then be suitable for an electrical socket.

Because of its three-dimensional socket arrangement, a stand-alone socket adapter in accordance with the present invention is spatially compact. For example, in the preferred embodiment exemplified in FIGS. 1-2, the module is approximately two inches on each side yet provides five sockets (in addition to a male plug). It is therefore equivalent to a one-foot long standard power strip providing five sockets. In dispersing its sockets on different faces, a cube shaped module, such as module 10 in FIGS. 1-2, facilitates simultaneous access for multiple electrical devices, especially those with bulky plugs, by reducing the potential interference between them. Also, by separating the plugs on different faces, such a module increases the ease with which one can connect and disconnect one external device without disrupting a neighboring device. Such properties contrast with those of previously known socket adapters, which lack the proper size, shape, and adaptability to meet such functional needs.

An advantage of modules in accordance with the present invention is the ease and flexibility with which they can be connected to each other. In FIG. 3A, for example, lower module 20 is equipped with a male plug on its top face (not visible), allowing it to be electrically connected to upper module 22 via a compatible female socket on the bottom face of module 22 (not visible). In this particular embodiment, the upper module 22 is equipped with a power cord 18, which can be of any convenient length. Such a bi-module system can be readily expanded into a multi-module, three-dimensional system, such as that shown in FIG. 3B, in which a third module 24 is electrically connected by a male plug (not shown) to a compatible female socket on module 20 and a fourth module 26 is electrically connected by a male plug (not shown) to a compatible female socket on module 24

While cube shaped modules are generally shown, as in FIGS. 1 and 2, modules in accordance with the present invention can have other shapes, so long as the module housing includes a plurality of faces that are suitable for electrical connectors. For example, a module may have a housing approximating the shape of a triangular block, such as that shown in modules 30 and 32, depicted in FIG. 4.

Each of these triangular modules has a major surface 12, on which is located a male connector. In one aspect, the male connector is located on rear face 36, as depicted by power cord input 18 on module 30, as in FIGS. 4A and 4B. In another aspect, the male connector is located on front face 34, as depicted by male plug 14 on module 32, as in FIGS. 4C and 4D. In addition, modules 30 and 32 each include two major surfaces 13 (FIGS. 4B and 4D), on which a female connector or socket is located. For module 32, the two major surfaces 13 are approximately at a right angle to each other and approximately at a 45° angle to major surface 12. A male connector at the end of cord 18 on module 30 can be plugged into a wall outlet. The male connector 14 on module 32 can then be plugged directly into one of the female sockets on module 30, the resulting combination shown in FIG. 4E. If cubic modules are plugged into the other female sockets, the power distribution system can extend vertically up, vertically down and horizontally, as schematically depicted by dotted lines in FIG. 4E. In other embodiments, the major surfaces can have angles to each other that are different from those shown in FIG. 4.

Figure 4:
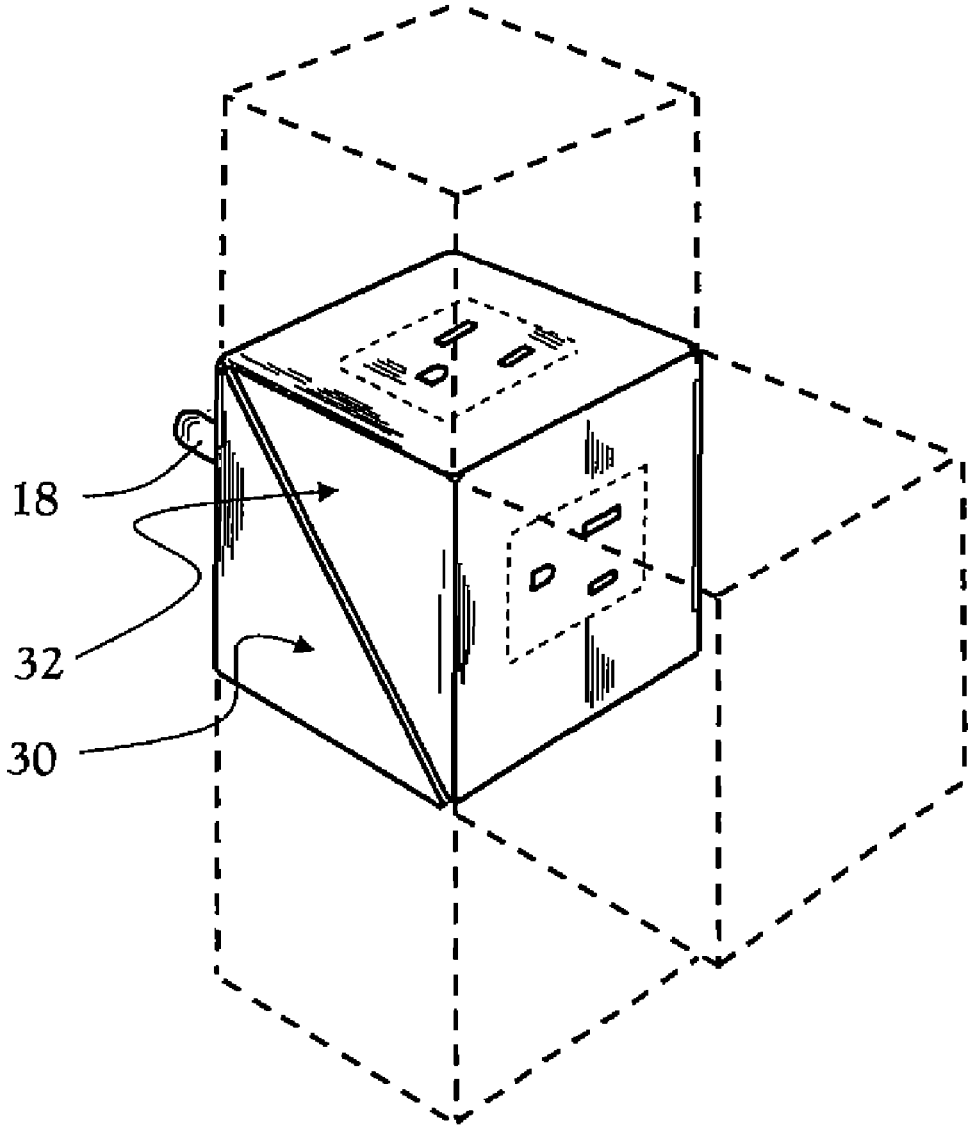
FIG. 4(A) is a left and front perspective view of another embodiment of a multi-module power strip, comprising a module having the approximate shape of a triangular block and having a power cord input.
FIG. 4(B) is a rear, bottom, and left perspective view of the module of FIG. 4(A)
FIG. 4(C) is a left and front perspective view of the triangular module having a plug.
FIG. 4(D) is a rear, bottom, and left perspective of the module of FIG. 4(C)
FIG. 4(E) is a perspective view showing the two modules of FIG. 4(A) and FIG. 4(C) electrically connected to each other with a power cord input on the rear side of the lower module, the dotted lines representing additional cube-shaped modules extending the system up, down, and right.

In accordance with the present invention, the configurations for multi-module systems are by no means limited to those shown in FIGS. 3-4. Cube shaped modules, for example, can be readily connected in six different directions, providing great diversity and flexibility in system configurations. FIG. 5 illustrates a few examples of such configurations. In one aspect, the system may have a symmetric structure, such as that exemplified by FIG. 5A. In another aspect, the system may have a whimsical configuration, such as that exemplified by the staircase-like structure shown in FIG. 5B or the dog-like (or bridge) structure shown in FIG. 5C. The flat or planar major surfaces allow a snug fit between the modules so that there is little space between them, thus creating an attractive and uncluttered appearance.

In one aspect, as exemplified by the examples shown in FIGS. 3-4, the modules are directly connected together. In another aspect, however, one or more modules in the system may be linked indirectly by an electrical cord. Such cord connections may be particularly useful when the desired electrical devices to be connected are interspersed. Such a system, for example, can be used to link devices located on opposite ends of a long shelf. As noted, the module faces that mediate such cord connections may not include a flat major surface as they need not provide a direct support function and intimate contact with an adjacent module.

A plurality of modules, whether cube shaped or not, therefore offers a wide array of configurations. Such flexibility allows a user to personally configure a system and to readily modify it as needed. Factors in selecting or modifying a particular configuration may include those based on function, organization, design, or personal aesthetics. Such customization, coupled with the system's compact designs, also encourages its use in an accessible and visible location, further enhancing its benefits. Collectively, these features provide desirable advantages that are not present in previously known power distribution strip systems.

Single module socket adapters and multi-module power distribution systems, including those illustrated in FIGS. 1-5, can include additional features. One feature is a power switch to control the flow of electricity from the external power source. This allows a user to switch off power without having to disconnect the system from the external power source. A power switch is particularly useful, for example, in the case of a remote adapter or strip that is connected to a wall outlet via a line cord, such as power switch 19 shown on the top surface of the module in FIG. 2. In a multi-module system, such as those shown in FIG. 3, the power switch 19 should be placed in the first module, or base module, connected to the external power supply.

Another feature that can be included in a power distribution system is a surge protector to protect against overcurrent conditions. Appropriate surge protectors are well-known in the art: They include fuse devices, such as single-use melting metal fuses; positive-temperature-coefficient (PTC) devices, such as self-resetting polymer-based or ceramic devices; metal-oxide devices, metal-oxide varistors (MOVs) including zinc-oxide and ceramic semiconductor structures, zener diodes, thyristor-based clamping structures, and the like, and combinations thereof.

In one aspect, the surge protector, like a power switch, should be placed in the base module of a multi-module system. In another aspect, the surge protected module can be devoted to a particular electrical device with anticipated high power consumption. In this setting, the local circuit could be protected without compromising the operation of 'safe' components at the adjacent modules.

Figure 6:
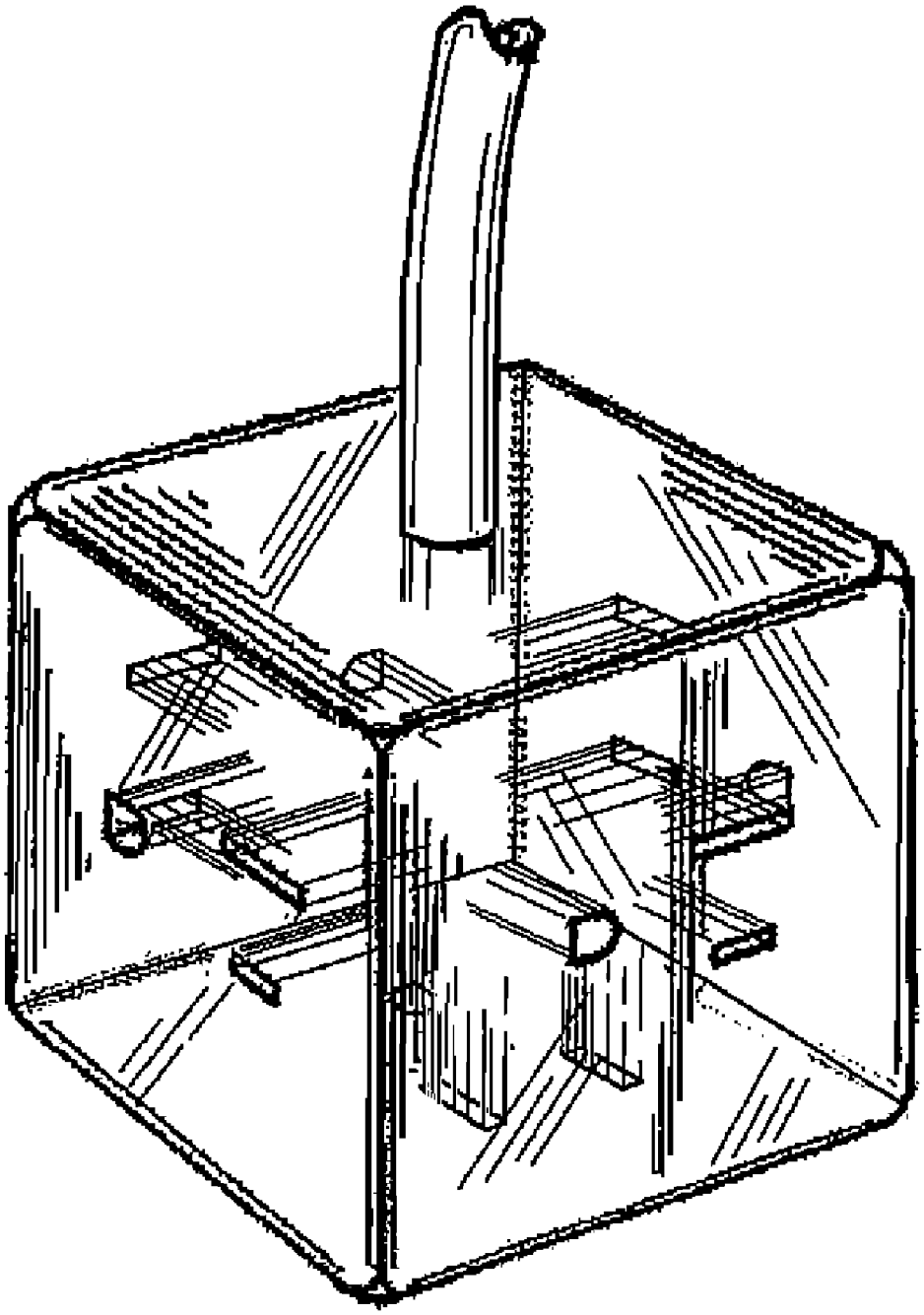
FIG. 6 is a top, left, and front perspective view of a power strip module having a transparent housing, showing a power cord input on the top side.

The modules can also include exteriorly visible identification. Such identification can be used to distinguish one module from another, based, for example, on different colors, patterns, textures, decorative lights etc. In another aspect, one module may be distinguished from another by a housing that is made from different materials. This distinction can arise, for example, by a housing that is light-transparent, such as that depicted in FIG. 6, or by a housing that is translucent, highly reflective, etc.

A module identification scheme can provide several benefits. It can allow a user to organize a power strip system according to intended use. Through color-coding, for example, a user can assign different modules to different external devices, such as the multiple components that comprise a computer or home entertainment system. Such plug organization complements the ease of plug removal already provided by the module's unique design.

Another application for such an identification scheme is to denote different functional characteristics of the modules. For example, a transparent housing is useful distinguish a base module from distribution modules. Similarly, different colors, patterns, etc. can be used to distinguish modules having particular socket styles or configurations.

More generally, such visible identification can provide a pleasing aesthetic, in addition to its utility as an organizational or functional tool. Pleasing visible features, such as different colors or LED lights, for example, provide yet another way to customize a system in accordance with a user's individual preferences and aesthetics. Module lighting can even facilitate use of the system in poorly lit settings. As noted above, such features can encourage a user to place the personalized power strip in a convenient location that is visible and accessible. Such user friendly features contrast with known power strips, whose general bulkiness and unsightly appearance typically leads a user to stash them in out-of-sight, inaccessible locations.

Advantageously, the present invention provides kits for modular power distribution systems, and in particular, a modular socket kit for an electrical outlet. Such kits include two or more modules. The specific design and features of each module can vary, depending on the intended applications and uses, e.g., domestic versus foreign use. In a preferred embodiment, the modules are approximately the same size and shape, and more particularly are approximately shaped as cubes, such as those exemplified by the embodiments shown in FIGS. 1-4.

In one embodiment, the kit includes a base module and at least one distribution module. Preferably, the base module provides a single male connector, which is used to electrically connect the base module to an external power supply, such as a wall-outlet. Preferably, the male connector is a plug or a power cord terminating in a plug. Preferably, the base module also includes an on/off power switch and a surge protector. The remaining major surfaces on the base module provide a plurality of female sockets. Preferably, each major surface has at most a single socket.

The distribution module preferably has on one major surface a single male connector that is compatible with at least one socket on the base module. The male connector may be a plug, power cord, or other suitable connector, The distribution module also provides a plurality of female sockets on the remaining major surfaces, preferably a single socket on each. Each socket can be connected to an external electrical device or alternatively, to another distribution module.

In accordance with the present invention, the kit may offer additional features, as discussed above, such as modules distinguished by color, design, texture, etc. Such exterior identification can provide a pleasing and fun aesthetic, allowing a user to customize the system according to personal taste. It also offers a simple coding scheme, allowing a user to assemble and categorize kit components according to application or function. The aesthetically pleasing appearance of individual modules and multi-module assemblies eliminates the necessity to hide such power distribution systems in invisible locations, such as behind a desk or in a corner. These pleasing attributes further enhance and simplify use of the systems.

More generally, kits in accord with present invention provide a manufacturer, salesperson, etc. with the ability to package compatible components, and to refine such packaging in response to market demands, preferences, etc. Such flexibility is particularly advantageous given the wide array of module designs and features encompassed by the present invention, not all of which are compatible. For example, base and distribution modules designed for use in Europe can be packed in one kit, while base and distribution modules designed for use in the United States can be packaged in a different kit. Kits can also be distinguished by other features, such as colors, decorative lighting, etc.

The present invention is not to be limited in scope by the specific embodiments described herein. Indeed, various modifications of the invention in addition to those described herein will become apparent to those skilled in the art from the foregoing description and the accompanying figures. Such modifications are intended to fall within the scope of the appended claims.

The invention claimed is:

1. A modular socket kit for an electrical outlet, comprising at least first and second modules, wherein each module comprises a housing including at least three major surfaces, wherein each major surface is at an angle to each neighboring major surface, wherein the first module comprises a) a male electrical plug extending from a first major surface; and b) two female electrical sockets, the sockets positioned on second and third major surfaces and electrically connected through the first module to the male plug; and wherein the second module comprises c) a male electrical plug extending from a first major surface and being adapted to be received in any female socket of the first module without blocking access to the other female socket, wherein the first major surface of the second module and any of the major surfaces with the female socket of the first module have substantially coextensive perimeters and make general intimate contact with each other; and d) two female electrical sockets, the sockets positioned on second and third major surfaces and electrically connected through the second module to the male plug.

2. The kit of claim 1, wherein the housing of at least one module is approximately shaped as a cube and includes six major surfaces, wherein each major surface is approximately at a right angle to each neighboring major surface.

3. The kit of claim 2, wherein the at least one cube-shaped module further includes five female electrical sockets, the sockets positioned on second, third, fourth, fifth, and sixth major surfaces and electrically connected through the module to the male plug.

4. The kit of claim 1, wherein the housing of at least one module is approximately shaped as a triangular block, including three major surfaces, wherein each major surface is at an angle to each neighboring major surface.

5. The kit of claim 4, wherein two of the major surfaces are approximately at a right angle to each other.

6. The kit of claim 1, wherein at least one module further comprises visible identification to distinguish it from at least one other module.

7. The kit of claim 6, wherein the visible identification indicates use or function of the module.

8. The kit of any of claims 1-5, wherein the first module further includes a surge protector electrically connected between the male plug and the female sockets of the first module to provide surge protection to a device connected to any of the female sockets.

9. The kit of any of claims 1-5, wherein the male electrical plug of the first module is connected to the first module by a power cord.

10. The kit of claim 1, further including a power switch in the first module to control the application of power from the male plug to the female sockets.

11. A socket adapter for an electrical outlet, comprising a housing including at least three major surfaces, wherein each major surface is at an angle to each neighboring major surface, wherein the adapter includes a) a male plug extending from a first major surface; and b) two female electrical sockets, the sockets positioned on second and third major surfaces and electrically connected through the adapter to the male plug, the first, second and third major surfaces have substantially equal size and shape so that when located on a separate adapter and brought together with the male plug mating with any of the female sockets they make intimate contact, the contacting major surfaces having substantially coextensive perimeters, and do not block access to the other female electrical socket.

12. The adapter of claim 11, wherein the housing is approximately shaped as a cube and includes six major surfaces, wherein each major surface is approximately at a right angle to each neighboring major surface.

13. The adapter of claim 12, further including five female electrical sockets, the sockets positioned on second, third, fourth, fifth, and sixth major surfaces and electrically connected through the module to the male plug.

14. The adapter of claim 11, wherein the male electrical plug is connected to the adapter housing by a power cord.

15. The adapter of any of claims 11-13, further including a surge protector electrically connected between the male plug and the female sockets to provide surge protection to a device connected to any of the female sockets.

16. The adapter claim 11, further including a power switch to control the application of power from the male plug to the female sockets.

17. A modular socket kit for an electrical outlet, comprising at least first and second modules, wherein each module comprises a housing including at least three major surfaces, wherein each major surface is at an angle to each neighboring major surface, wherein the first module comprises a) a male electrical plug extending from a first major surface; and b) two female electrical sockets, the sockets positioned on second and third major surfaces and electrically connected through the first module to the male plug, wherein the first major surface and the second major surface have substantially equal size and shape; and wherein the second module comprises c) a male electrical plug extending from a first major surface and being adapted to be received in any female socket of the first module without blocking access to the other female socket, wherein the first major surface of the second module and the third major surface of the first module have substantially coextensive perimeters and make general intimate contact with each other; and d) two female electrical sockets, the sockets positioned on second and third major surfaces and electrically connected through the second module to the male plug, wherein the second and third major surfaces have substantially equal size and shape and are complementary in size and shape with the first and second major surfaces of the first module.

18. The kit of claim 17, wherein each housing is approximately shaped as a triangular block, including three major surfaces, wherein each major surface is at an angle to each neighboring major surface.

19. The kit of claim 18, wherein two of the major surfaces are approximately at a right angle to each other.

20. The kit of claim 17, wherein the male electrical plug of the first module is connected to the first module by a power cord.

* * * * *